US005355142A

United States Patent [19]

Marshall et al.

[11] Patent Number: 5,355,142

[45] Date of Patent: Oct. 11, 1994

[54] MICROSTRIP ANTENNA STRUCTURE SUITABLE FOR USE IN MOBILE RADIO COMMUNICATIONS AND METHOD FOR MAKING SAME

[75] Inventors: Robert Marshall, Littleton; Mark Rogers; Theresa C. Boone, both of Boulder; Farzin Lalezari, Louisville, all of Colo.

[73] Assignee: Ball Corporation, Muncie, Ind.

[21] Appl. No.: 776,160

[22] Filed: Oct. 15, 1991

[51] Int. Cl.[5] ..... H01Q 1/38

[52] U.S. Cl. ..... 343/700 MS; 343/872; 343/830

[58] Field of Search ..... 343/700 MS File, 787, 343/846, 828, 830, 872; 29/60; H01Q 1/38

[56] References Cited

U.S. PATENT DOCUMENTS

| | | | |
|---|---|---|---|
| 4,370,658 | 1/1983 | Hill | 343/713 |
| 4,395,713 | 7/1983 | Nelson et al. | 343/713 |
| 4,543,584 | 9/1985 | Leer | 343/715 |
| 4,700,194 | 10/1987 | Ogawa et al. | 343/700 MS File |
| 4,835,541 | 5/1989 | Johnson et al. | 343/700 MS File |
| 4,907,006 | 3/1990 | Mishikawa et al. | 343/700 MS File |
| 5,181,044 | 1/1993 | Matsumoto et al. | 343/700 MS File |

FOREIGN PATENT DOCUMENTS

| | | |
|---|---|---|
| 0332139A2 | 9/1989 | European Pat. Off. . |
| 0366393A2 | 5/1990 | European Pat. Off. . |
| 0444679A2 | 9/1991 | European Pat. Off. . |
| 2635415 | 2/1990 | France . |

OTHER PUBLICATIONS

IEEE The Sixteenth Conference of Electrical & Electronics Engineers in Israel, Mar. 7–9, 1989, Tel Aviv, Israel, pp. 1–4, Matzner et al., "A Two Dimensional Solution of a Rectangular Patch Antenna".

*Primary Examiner*—Donald T. Hajec
*Assistant Examiner*—Tan Ho
*Attorney, Agent, or Firm*—Gilbert E. Alberding

[57] ABSTRACT

The present invention provides a microstrip antenna that includes a microstrip element with an integral member which is used to establish an electrical connection between the microstrip element and a transmission line. The use of the integral member to establish this electrical connection yields advantages in performance, reliability, and manufacturing, among others, that make the microstrip antenna particularly suitable for mobile applications. The present invention also provides a method of manufacturing such a microstrip antenna.

22 Claims, 7 Drawing Sheets

MICROSTRIP ANTENNA STRUCTURE SUITABLE FOR USE IN MOBILE RADIO COMMUNICATIONS AND METHOD FOR MAKING SAME

BACKGROUND OF THE INVENTION

1. Field of the Invention

The present invention relates to microstrip antennas and, in particular, to a microstrip antenna that is well suited for use in mobile radio applications.

2. Description of the Related Art

The typical microstrip antenna includes a ground plane and a microstrip element that are located parallel to one another and between which is located a dielectric material. Also included in the typical microstrip antenna is a transmission line that provides a communication path for radio frequency (rf) signals to and from the microstrip element and the ground plane. To transmit rf signals using the microstrip antenna, an rf signal is applied by a transmitter to the transmission line which, in turn, applies the rf signal to the microstrip element and the ground plane. In response, an electromagnetic signal is radiated between the edges of the microstrip element and the ground plane, in a pattern and at a frequency that is dependent upon, among other things, the positional and dimensional characteristics of the microstrip element, the ground plane, and the dielectric. Conversely, during reception, the microstrip element and the ground plane resonate upon interacting with an electromagnetic signal of an appropriate frequency to produce an rf signal that is provided to by the transmission line to a receiver for decoding.

Microstrip antennas have been found to be particularly well-suited to mobile radio communications and the subclass of portable radio communications, due, at least in part, to their substantially omnidirectional radiation patterns, i.e., radiation patterns that exhibit substantially the same gain in any direction within a particular plane of interest (generally a horizontal plane), and due to the relatively high efficiency that this type of antenna is capable of achieving in combination with its relatively small size and weight. A substantially omnidirectional radiation pattern is of fundamental concern in mobile radio communications because of the continually changing orientation of the mobile radio with respect to the radio with which communications are being conducted, hereinafter referred to as the communicating radio. For example, in cellular radio networks, the orientation of the mobile radio that is located in an automobile or other mobile vehicle changes with respect to the communicating radio as the location of the automobile changes within the cell, i.e., the area within which the communicating radio is operational. As a consequence, it is important that the radiation pattern of the antenna be substantially omnidirectional. Similarly, a high efficiency is of concern in mobile radio communications because the distance between the mobile radio and the communicating radio typically varies widely. Given this variation, an antenna with a high efficiency allows communications to be conducted over a correspondingly broad range of distances between the mobile radio and the communicating radio.

Among the factors that can adversely affect the radiation pattern and/or the gain of a microstrip antenna is the manner in which the transmission line is connected to the microstrip element and/or the ground plane. For example, U.S. Pat. No. 4,700,194 ('194), which issued on Oct. 13, 1987 to Ogawa et al., and is entitled "Small Antenna," indicates that the location of the connection between the transmission line and the ground plane has a substantial effect on the radiation pattern and gain of the microstrip antenna.

Another feature of the connection between the transmission line and the microstrip element that can adversely affect the radiation pattern and gain of the microstrip antenna is the inductance associated with the connection. For example, when a coaxial cable is used for the transmission line, a length of the center conductor of the coaxial cable must be exposed, i.e., extend beyond the end of the outer conductor, for connection to the microstrip element. The more of the center conductor that is exposed, the greater the resulting inductance. As the inductance increases, the mismatch in impedance between the coaxial cable and the microstrip element increases. This, in turn, adversely affects the radiation pattern and gain of the microstrip antenna.

U.S. Pat. No. 4,835,541 ('541), which issued on May 30, 1989 to Johnson et al. and is entitled "Near-Isotropic Low-Profile Microstrip Radiator Specially Suited for Use as a Mobile Vehicle Antenna," proposes the use of an impedance matching network to counteract the inductance associated with the connection of the transmission line to the microstrip element. The proposed impedance matching network, while possibly addressing the performance drawbacks associated with an impedance mismatch, reduces the desirability of the resulting microstrip antenna for mobile radio communication applications. Namely, the impedance matching network proposed in the U.S. Pat. No. '541 adds several additional parts to the microstrip antenna that must be connected to one another during manufacture. Since a characteristic of most, if not all, mobile radio communication applications is that the antenna is subjected to a considerable amount of physical stress, such as vibrations and temperature fluctuations, the corresponding increase in the number of interconnections necessitated by the increased number of parts associated with the impedance matching network make the resulting microstrip antenna susceptible to failure.

Another requirement or highly desirable feature in many mobile radio communication applications is that the antenna be concealed from view. For example, it is desirable to conceal the antenna associated with the cellular telephone in an automobile so that thieves are not readily able to determine whether or not the automobile contains a cellular phone. The U.S. Pat. No. '541 discloses a microstrip antenna that is concealed by mounting it in the space between a plastic roof and a headliner in a passenger vehicle. Use, however, of the embodiment of the microstrip antenna that employs an impedance matching network increases the overall height profile of the antenna and, as a consequence, reduces the ability of such an antenna to be concealed. Moreover, the impedance matching network necessitates significant reworking of the manner in which the microstrip antenna is mounted to the roof of the automobile because the impedance matching network makes impossible the flush mounting of the microstrip antenna to the roof that is possible when the impedance matching network is omitted.

Also of concern in many mobile radio communication applications is the relationship between the number of discrete parts comprising the microstrip antenna and the cost of assembling the antenna. Specifically, as the number of discrete parts comprising the microstrip antenna increases, the cost of the microstrip antenna increases due to the increased amount of time necessary to assemble the parts into an antenna. This increased cost, in turn, inhibits the use of microstrip antennas in, for example, mass consumer market applications, such as the cellular telephone market, even though the microstrip antenna possesses performance and/or structural advantages over alternative types of antennas.

Also desirable in many mobile radio communication applications is the ability to readily attach and detach an antenna from a surface. For example, if it is not feasible to conceal the antenna, then the ability to attach the antenna to an exposed surface when the antenna is in use and detach the antenna when not in use is, in many instances, a highly desirable feature.

Yet of further concern in portable or mobile communications by radio is the exterior aspect of the antenna. For example, if the antenna is used in an application where it is exposed to external forces, such as wind, the external aspect of the antenna can affect the ability of the antenna to withstand such forces. Moreover, in many consumer oriented mobile radio applications, such as cellular telephones, the exterior aspect of the antenna typically has significant impact on the appeal of the antenna to the consumer.

Based on the foregoing, there is a need for a microstrip antenna that addresses the deficiencies of known microstrip antennas and, in particular, of those microstrip antennas that are employed in mobile radio communication applications. Specifically, there is a need for a microstrip antenna that provides an improved degree of reliability, that is readily adapted to concealment, and that employs a low part count to realize part as well as manufacturing cost benefits. In this regard, there is a need for a microstrip antenna that substantially eliminates the use of an impedance matching network. In addition, a microstrip antenna is needed that provides a substantially omnidirectional radiation pattern and a high efficiency. Further, a microstrip antenna that can be readily attached and detached from a surface is needed. Moreover, there is a need for a microstrip antenna with an external aspect that addresses the external forces that can affect the operation of the antenna and/or the appeal of the antenna to the consumer.

SUMMARY OF THE INVENTION

The present invention provides a microstrip antenna that is suitable for use in mobile radio communication applications and a method for manufacturing the microstrip antenna that possesses several advantages over known microstrip antennas and methods for manufacturing microstrip antennas.

The microstrip antenna of the present invention, like known microstrip antennas, includes a ground plane and a microstrip element with an electrically conductive planar surface that is located substantially parallel to, but separated from, the ground plane. Unlike known microstrip antennas, however, the microstrip element includes a member that is integral to the planar surface of the microstrip element and that provides a feed point for connecting one of the two conductors of the transmission line to the microstrip element. The member extends into the space between the ground plane and the planar surface of the microstrip element and exhibits little, if any, inductance. Consequently, the member is used to reduce the exposure of the conductor that must be electrically connected to the planar surface and, as a consequence, any inductance attributable to the exposed conductor. This, in turn, reduces any impedance mismatch between the transmission line and the microstrip element and improves the radiation pattern and gain of the microstrip antenna. Relatedly, since the microstrip antenna of the present invention substantially avoids the need for a separate element, like an impedance matching network, to establish an electrical connection between the transmission line and the microstrip element, there is a commensurate reduction in the number of electrical or physical connections that must be made in order to realize the antenna. This, in turn, increases the reliability of the microstrip antenna, especially in mobile radio communication applications, where the antenna is typically subjected to high physical stress. Furthermore, the integral member facilitates concealment of the microstrip antenna due to its location between the ground plane and the microstrip antenna. Additionally, the integral member reduces part related manufacturing costs by reducing the number of parts necessary to realize the microstrip antenna of the present invention.

One embodiment of the microstrip antenna includes a magnetic surface that allows the antenna to be attached and detached from appropriate surfaces. This feature provides advantages, such as the ability to conceal the antenna and to protect the antenna from environmental damage when not in use.

Another embodiment of the microstrip antenna provides an external aspect that makes the antenna less susceptible to external forces and more aesthetically appealing. Specifically, the antenna includes a radome in which substantially all of the other elements of the antenna are located, so that when the antenna is mounted to a surface, substantially only the radome is visible.

The method of the present invention includes forming a microstrip element having an electrically conductive planar surface and a member that is integral with, but at an angle to, the surface. In one embodiment of the invention, the planar surface and the member are formed by appropriately bending a piece of electrically conductive material. In another embodiment of the invention, the planar surface and the member of the microstrip element are realized by coating or depositing an electrically conductive material on the surface of a substantially non-electrically conductive material, such as plastic. The non-electrically conductive material can be used to achieve a radome, a structure that protects the microstrip antenna from the outside environment while allowing electromagnetic radiation to pass between the microstrip antenna and the outside environment. The method further includes positioning a ground plane so that it is substantially parallel to the planar surface of the microstrip element and so that the integral member is positioned in the space between the planar surface of the microstrip element and the ground plane. Further, the method of the present invention includes electrically coupling one conductor of the transmission line to the member and the other conductor of the transmission line to the ground plane.

The method of the present invention provides several advantages. Namely, due to the use of the integral member, a connection between the transmission line and the microstrip element is realized that reduces impedance mismatch and improves the gain as well as the radiation pattern of the antenna. Moreover, due to the various degrees to which parts of the antenna have been integrated into one another, this method has the further advantage of allowing a microstrip antenna to be produced in a relatively few number of steps. For example, if the desired microstrip antenna is a one-quarter wavelength antenna where the ground plane and the microstrip element are connected by a shorting section that allows these elements of the antenna to be integrated into a single element of the antenna, then the microstrip antenna can be assembled in two steps by simply connecting the conductors of the transmission line to the ground plane and the planar surface of the microstrip element. By providing a method that allows a microstrip antenna to be produced in relatively few steps, cost savings accrue that increase the number of applications in which the resulting antenna can be used and, as a result, the number of applications in which the other benefits of the microstrip antenna can be realized. Relatedly, the integration of parts has the further benefit of producing a more reliable antenna due to the fewer interconnections required to assemble the microstrip antenna.

Based on the foregoing, the present invention provides a microstrip antenna and a method for manufacturing same that provides the performance required for mobile radio communication applications while at the same time providing reliability, low part count, a structure that can be readily concealed, and cost savings in the manufacturing process that allows the benefits of the microstrip antenna to be realized in a greater number of applications. Moreover, the present invention provides a microstrip antenna that can be readily attached to and detached from appropriate surfaces, is less susceptible to environmental effects, and possesses an appealing appearance.

DETAILED DESCRIPTION OF AN EMBODIMENT OF THE INVENTION

Figure 1:
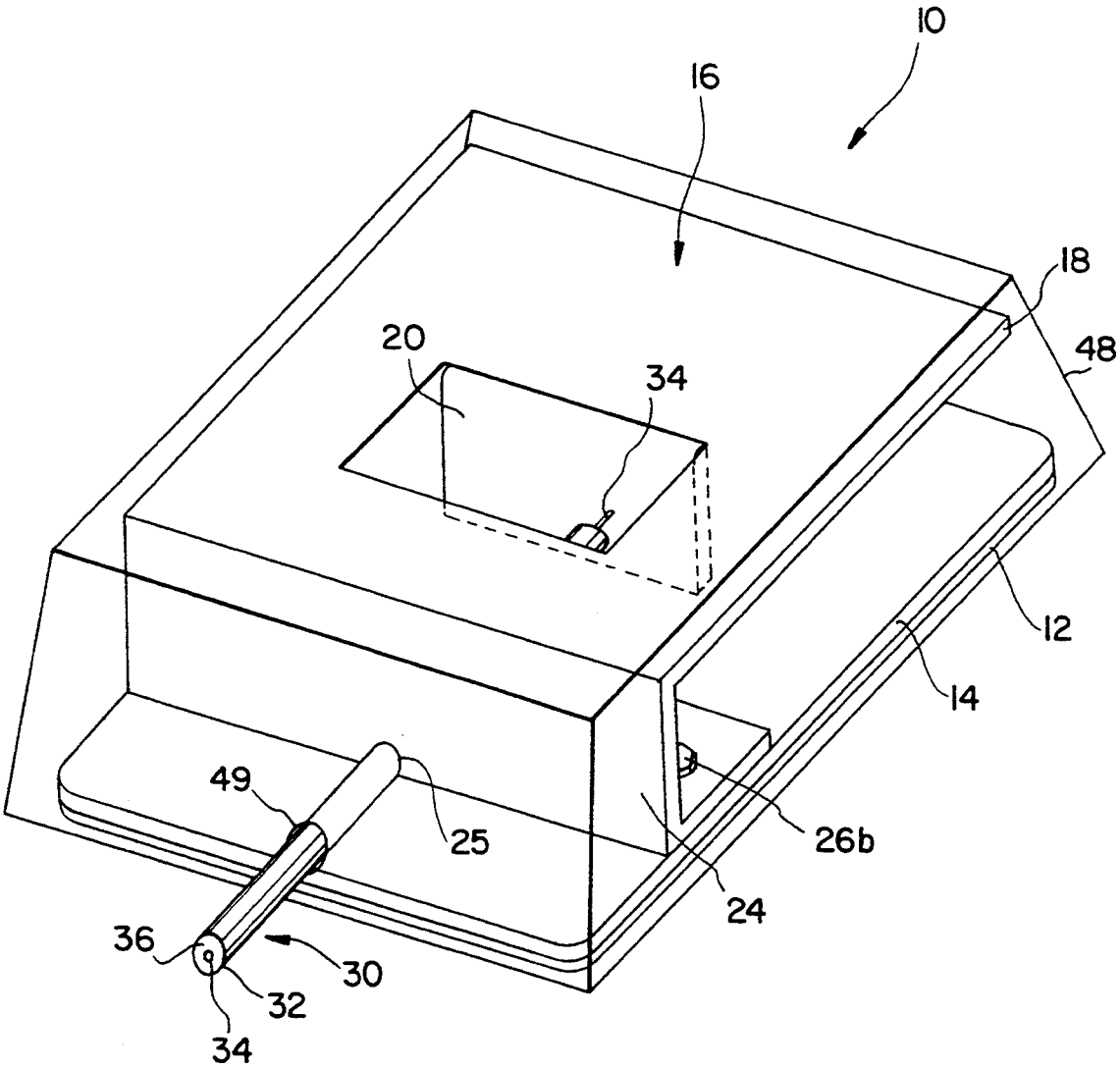
FIG. 1 is a perspective view of the microstrip antenna of the present invention.

With reference to FIGS. 1 and 2A–2C, an embodiment of the microstrip antenna of the present invention 10, hereinafter referred to as antenna 10, is illustrated. The antenna 10 includes a magnetic base 12 that allows the antenna 10 to be readily mounted and demounted from an appropriate surface. Attached to the magnetic base 12 is a ground plane 14 that is made of an electrically conductive material and provides an electrical reference or ground point for the antenna 10.

Located above the ground plane 14 is a microstrip element 16 that is made of an electrically conductive material and in combination with the ground plane 14 forms a resonant cavity suitable for the transmission and reception of radio frequency (rf) signals. The microstrip element 16 includes an electrically conductive planar member 18 that cooperates with the ground plane 14 to form the resonant cavity. The microstrip element 16 also includes a feed member 20 that is made of an electrically conductive material and is integral or continuous with the planar member 18. The feed member 20 provides a path with little inductance for electrically connecting a transmission line to the planar member 18. The feed member 20 defines at least a portion of an edge of a hole that extends through the microstrip element 16. The microstrip element 16 is positioned so that the planar member 18 is located substantially parallel to, but spaced from, the ground plane 14 and the feed member 20 is located in an air space 22 intermediate the ground plane 14 and the planar member 18. The air in the air space 22 serves as a dielectric. If appropriate, a dielectric material, such as Teflon, can be used in place of the air space 22.

The planar member 18 has a length that is approximately equal to one quarter of the wavelength ($\lambda/4$) of the center frequency at which the antenna 10 is designed to operate. Microstrip antennas that have a length substantially equal to $\lambda/4$ are frequently referred to as quarter-wave microstrip antennas and exhibit a substantially omnidirectional radiation pattern in the azimuth plane that lends such antennas to mobile radio communications. Since the antenna 10 is a quarter-wave microstrip antenna, it also includes a shorting section 24, which is L-shaped and integral with the microstrip element 16, for use in establishing an electrical connection between the ground plane 14 and the edge of the microstrip element 16. The shorted edge of the microstrip element 16 is the zero-impedance point for a quarter-wave microstrip antenna. A first hole 25 through the shorting section 24 provides access for a transmission line to the air space 22 where the transmission line is connected to the ground plane 14 and the feed member 20. Four sheet metal screws 26A, 26B, 26C and 26D are used to establish an electrical and mechanical connection between the ground plane 14 and the microstrip element 16. The screws 26A, 26B, 26C and 26D also clamp a transmission line between the ground plane 14 and a cable clamp to establish a mechanical connection therebetween. In addition to forming a mechanical connection, the cable clamp also establishes an electrical connection between one conductor of the transmission line and the ground plane 14. If necessary or desirable, the sheet metal screws 26A and 26B can be eliminated and the sheet metal screws 26C and 26D relied upon to establish the electrical and mechanical connections.

The antenna also includes a transmission line 30 for providing rf signals to, and receiving rf signals from, the resonant cavity formed by the ground plane 14 and the planar member 18 of the microstrip element 16. The transmission line 30 extends through the first hole 25 and includes a first electrical conductor 32 that is electrically connected to the ground plane 14 and a second electrical conductor 34 that is connected to the feed member 20 within the air space 22 defined between the ground plane 14 and the planar member 18. In the illustrated embodiment, the transmission line 30 is a coaxial cable where the first electrical conductor 32 is the outer conductor of the coaxial cable, which is typically a woven wire mesh, and the second electrical conductor 34 is the center conductor of the coaxial cable that is separated from the outer conductor by a dielectric 36, such as Teflon. The transmission line 30 is located in the air space 22 so that it follows a substantially straight line in a plane that is substantially parallel to the microstrip element 16 throughout the air space 22.

The antenna 10 also includes a cable clamp 38 for use in establishing an electrical connection between the first electrical conductor 32 of the transmission line 30 and the ground plane 14. In addition, the cable clamp 38 provides a mechanical connection between the transmission line 30 and the ground plane 14 that reduces the likelihood of the transmission line 30 becoming disconnected from the ground plane 14 and the microstrip element 16.

The dielectric insulator 36 of the transmission line 30 is used to prevent the second electrical conductor 34 of the transmission line 30 from coming into contact with the ground plane 14 within the air space 22.

Figure 2A:
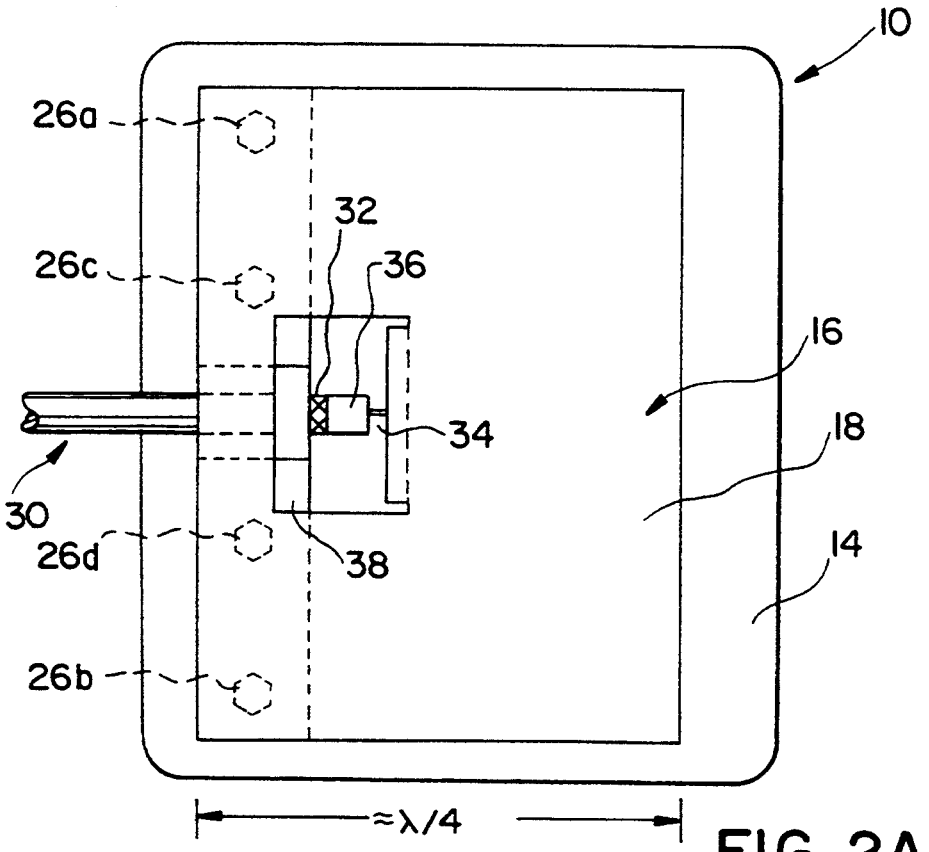
FIGS. 2A–2C are top, front, and side views, respectively, of the embodiment of the microstrip antenna illustrated in FIG. 1, less the radome shown in FIG. 1.
Figure 2B:
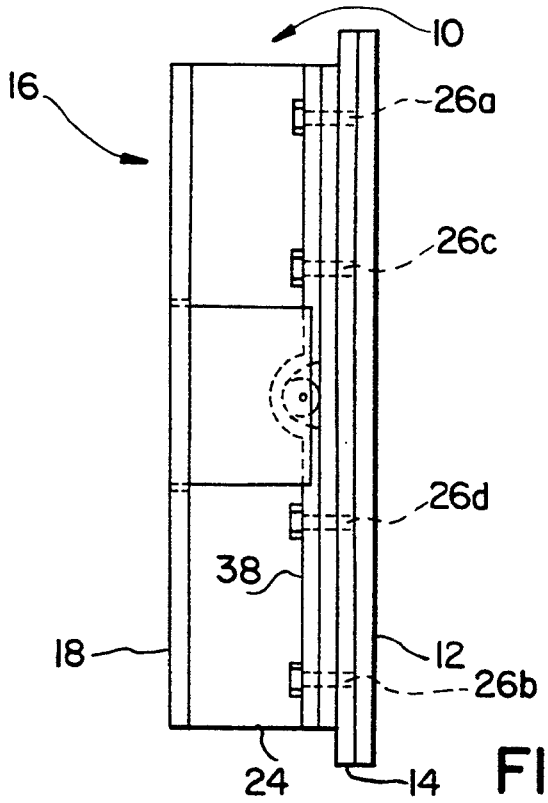
Figure 2C:
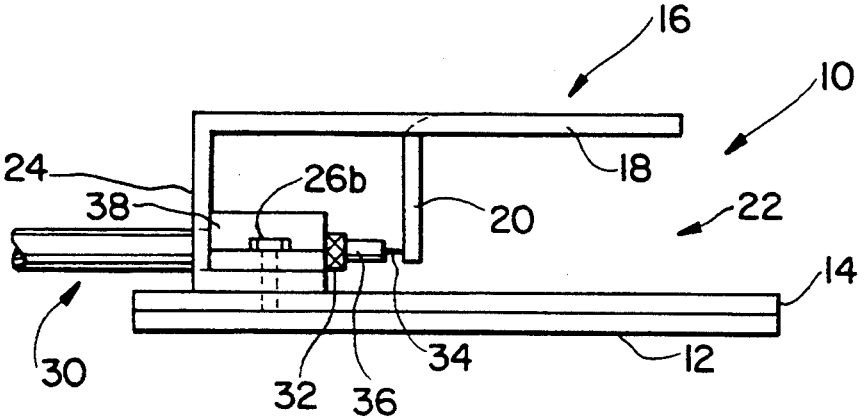
Figure 2D:
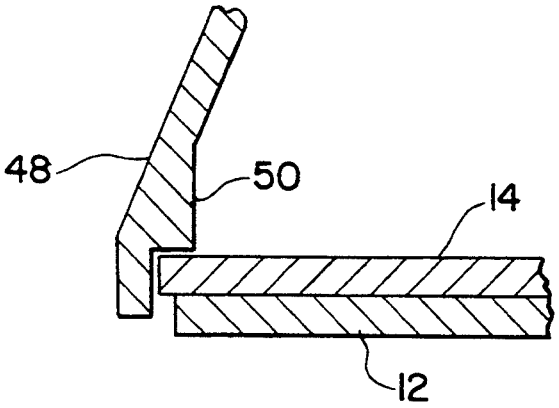
FIG. 2D is a cross-sectional side view that illustrates the relationship of the radome to the magnetic base and ground plane of the microstrip antenna shown in FIG. 1.

A radome 48 is provided for protecting the elements of the antenna 10 mentioned thus far from the environment while at the same time allowing electromagnetic radiation to pass between the outside environment and the resonant cavity formed by the ground plane 14 and the microstrip element 16. A second hole 49 is provided in the radome 48 for accommodating the transmission line 30. The radome 48 preferably extends past the lower surface of the ground plane 14 so that, when the antenna 10 is viewed from the side, substantially only the radome 48 is visible, as shown in FIG. 2D. This provides the antenna 10 with a smooth low-profile and aesthetically pleasing package, and reduces the possibility of the antenna 10, when magnetically attached to an appropriate surface for example, from being dislodged by something in the exterior environment, such as a tree limb. The radome 48 includes a plurality of flanges 50 for use in properly positioning the radome 48 relative to the ground plane 14. The flanges 50 also provide surfaces to which adhesive is applied for bonding the radome 48 to the ground plane 14.

Figure 3:
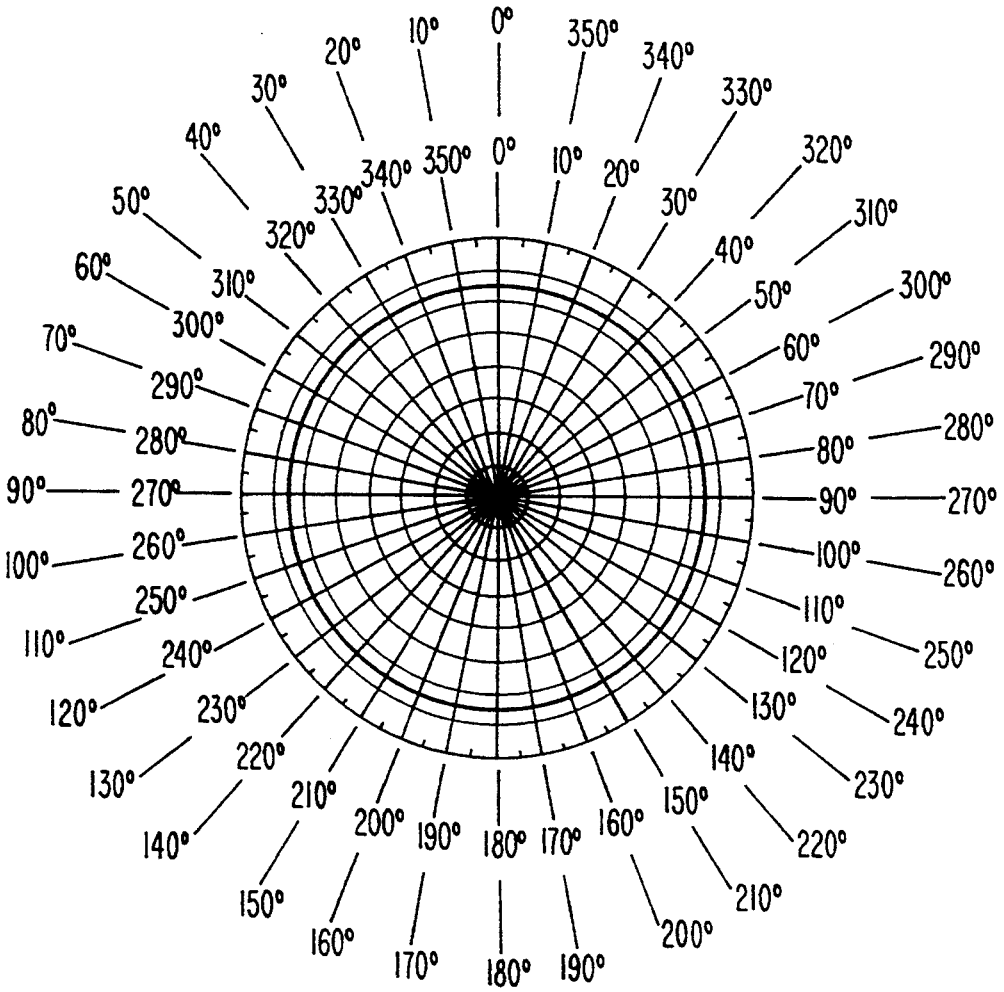
FIG. 3 is a plot that illustrates the omnidirectional operational characteristic of the antenna illustrated in FIG. 1 in the azimuth-plane.

When the antenna 10 is used to transmit information, an rf signal is provided by the transmission line 30 to the ground plane 14 and the planar member 18 of the microstrip element 16. In response, the ground plane 14 and the planar member 18 produce an electromagnetic signal that has a substantially omnidirectional radiation pattern in the azimuth plane, a plane that is coincident with the planes of the ground plane 14 and the planar member 18, as shown in FIG. 3. Similarly, the ground plane 14 and the planar member 18, upon receiving an electromagnetic signal, cause an rf signal to be applied to the transmission line 30. Notably, the feed member 20 allows the electrical connection between the first electrical conductor 32 and the ground plane 14 and the electrical connection between the second electrical conductor 34 and the feed member 20 to be very close. Consequently, only a small amount of the second electrical conductor 34 need be exposed, i.e., extend past the end of the first electrical conductor 32, to make the electrical connection to the feed member 20. Due to this small exposure, the second electrical conductor 34 exhibits little inductance during transmission or reception of rf signals. Further, since the feed member 20 exhibits little inductance, impedance mismatch between the transmission line 30 and the microstrip element 16 is reduced which, in turn, improves the gain and radiation pattern of the antenna 10. This advantage is further enhanced by locating the feed member 20 at a location with respect to the planar member 18 that reduces impedance mismatch, which is the 50 point when the transmission line 30 is a 50 coaxial cable.

Due to the integration of the planar member 18 and the feed member 20 of the microstrip element 16, manufacture and assembly of the antenna 10 takes little time and, as a consequence, is relatively inexpensive. Specifically, the sheet metal screws 26A, 26B, 26C, 26D establish a mechanical and an electrical connection between the ground plane 14 and the edge of the planar member 18 of the microstrip element 16 by way of the shorting section 24. In addition, the cable clamp 38 and the sheet metal screws 26A, 26B, 26C, 26D cooperate to establish an electrical connection between the ground plane 14 and the first electrical conductor 32 of the transmission line 30. Electrical connection of the second electrical conductor 34 of the transmission line 30 to the planar member 18 of the microstrip element 16 is accomplished by soldering the second electrical conductor 34 to the feed member 20.

Figure 4:
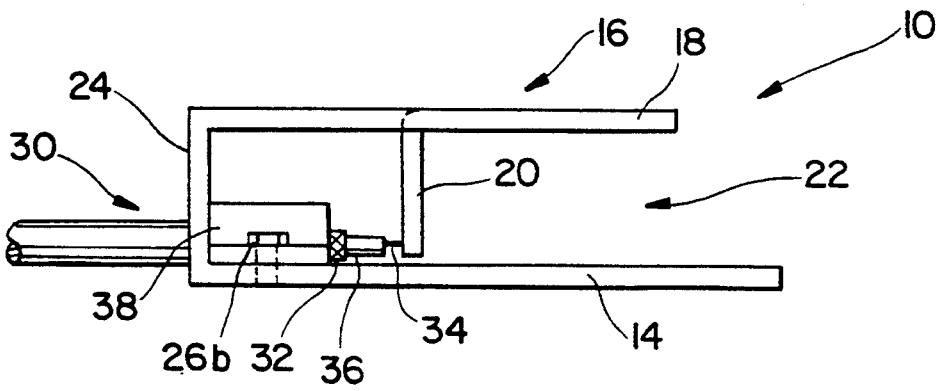
FIG. 4 illustrates an embodiment of the microstrip antenna where the microstrip element, shorting section, and ground plane are a single integrated unit.

With reference to FIG. 4, another embodiment of the antenna 10 is illustrated. As a matter of convenience, elements of the embodiment of the antenna 10 illustrated in FIG. 4 that are substantially functionally equivalent to the elements of the embodiment of the antenna 10 illustrated in FIGS. 1 and 2A–2C are given the same reference numbers. In the antenna 10 illustrated in FIG. 4, the ground plane 14, the planar member 18 and the feed member 20 of the microstrip element 16, and the shorting section 24 are integral with one another, or, stated another way, formed from one continuous piece of material. Consequently, these elements can be formed by appropriately producing a piece of electrically conductive sheet material so that the feed member 20 can be formed and then bending the sheet material so that the form of these elements that is illustrated in FIG. 4 is achieved. Due to this integration of parts or elements of the antenna 10, there is no need to establish a mechanical and electrical connection between the ground plane 14, the shorting section 24 and the planar member 18 of the microstrip element 16. Consequently, assembly of the antenna 10 merely requires establishing an electrical connection between the ground plane 14 and the first electrical conductor 32 of the transmission line 30 and establishing an electrical connection between the planar member 18 and the second electrical conductor 34 of the transmission line 30 by way of the feed member 20. The electrical connection between the ground plane 14 and the first electrical conductor 32 is established using the cable clamp 38 and the four sheet metal screws 26A, 26B, 26C, 26D. A solder joint is used to establish the electrical connection between the second electrical conductor 34 and the feed member 20 of the microstrip element 16.

Figure 5:
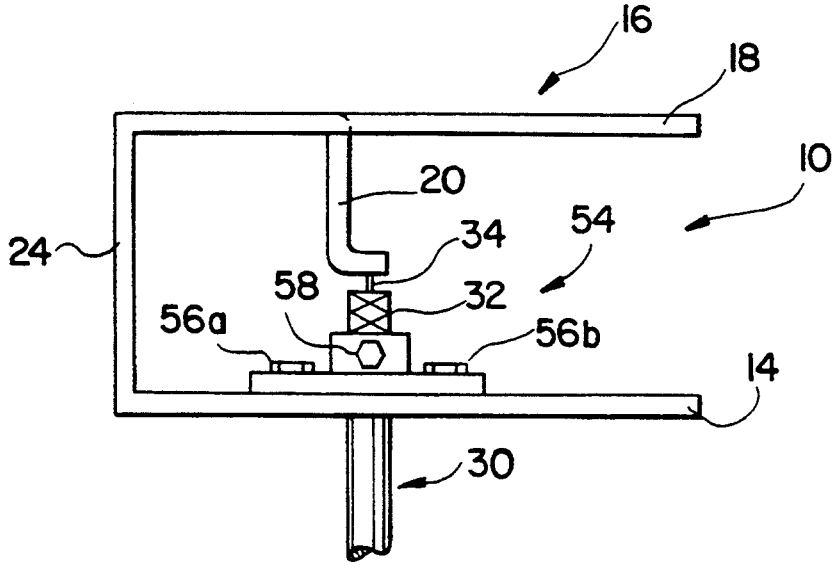
FIG. 5 is a side view of another embodiment of the invention in which the transmission line extends substantially perpendicular to the ground plane.

FIG. 5 illustrates another embodiment of the antenna 10 in which the feed member 20 is integral or continuous with the planar member 18 of the microstrip element 16. Elements of the embodiment of the antenna 10 illustrated in FIG. 5 that substantially correspond to elements of the previously discussed embodiments of the antenna 10, as a matter of convenience, are given the same reference numbers. The primary difference between the antenna 10 illustrated in FIG. 5 and previously discussed embodiments of the antenna 10 is that the transmission line 30 extends in a substantially straight line in a plane that is substantially perpendicular to the ground plane 14. The transmission line is mechanically connected to the ground plane 14 by a connector 54. The connector 54 includes screws 56A, 56B for mechanically connecting the connector 54 to the ground plane 14. Also included in the connector 54 is a screw 58 for mechanically connecting the transmission line to the connector 54. The connector 54, the screws 56A, 56B, and the screw 58 are all electrically conductive so that in addition to establishing a mechanical connection between the transmission line 30 and the ground plane 54, an electrical connection is also established between the first conductor 32 of the transmission line and the ground plane 14 as discussed in the previous embodiments of the antenna 10. The second electrical conductor 34 of the transmission line 30 is soldered or otherwise electrically connected to the feed member 20 that, as in the previously discussed embodiments of the antenna 10.

Figure 6A:
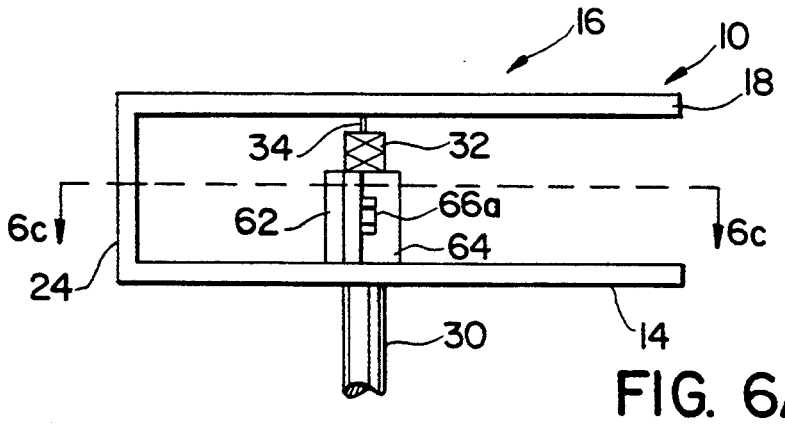
FIGS. 6A and 6B are side and end views, respectively, of yet another embodiment of the invention in which the transmission line extends substantially perpendicular to the ground plane and the feed member is integral with the ground plane.
Figure 6B:
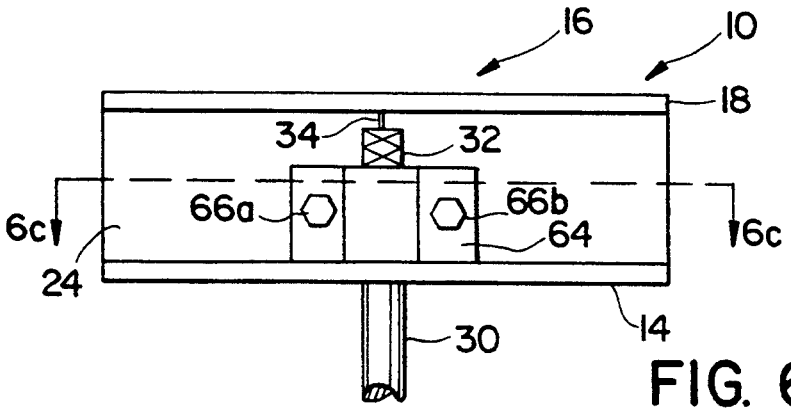
Figure 6C:
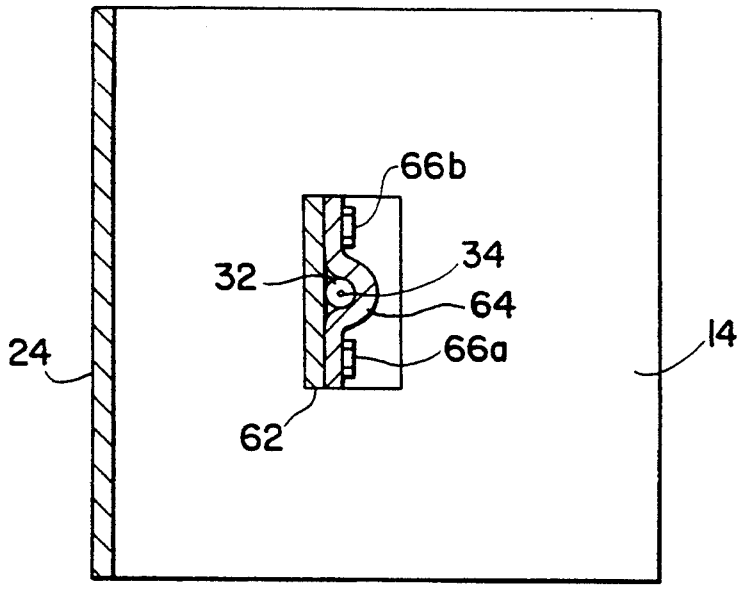
FIG. 6C is a cross-sectional view of the embodiment of the antenna illustrated in FIGS. 6A–6B.

With reference to FIGS. 6A–6C, yet another embodiment of the antenna 10 is illustrated in which the transmission line 30 extends substantially perpendicular to the ground plane 14. The antenna 10 includes a feed member 62 that is integral with the ground plane 14, in contrast to previously discussed embodiments of the antenna 10. The feed member 62 in combination with a cable clamp 64 and a pair of screws 66A, 66B, provides an electrical connection between the first conductor 32 of the transmission line 30 and the ground plane 14. In addition, the feed member 62, the cable clamp 64, and the screws 66A, 66B, provide a mechanical connection between the transmission line 30 and the microstrip element 16. The second conductor 34 of the transmission line 30 is soldered to the planar member 18 at the 50Ω point.

With respect to the embodiments of the antenna 10 illustrated in FIGS. 4,5 and 6A–6C, a radome that is similar to the radome 48 shown in FIG. 1 can be employed. If, however, a radome is impracticable or undesirable, the ground plane 14, microstrip element 16, and shorting section 24 can be coated with TEFLON or other low adhesion material. This inhibits dirt and the like from adhering to these elements and inhibiting the operation of the antenna 10. The TEFLON also facilitates the speedy cleaning of these elements should any material adhere to them.

Figure 7A:
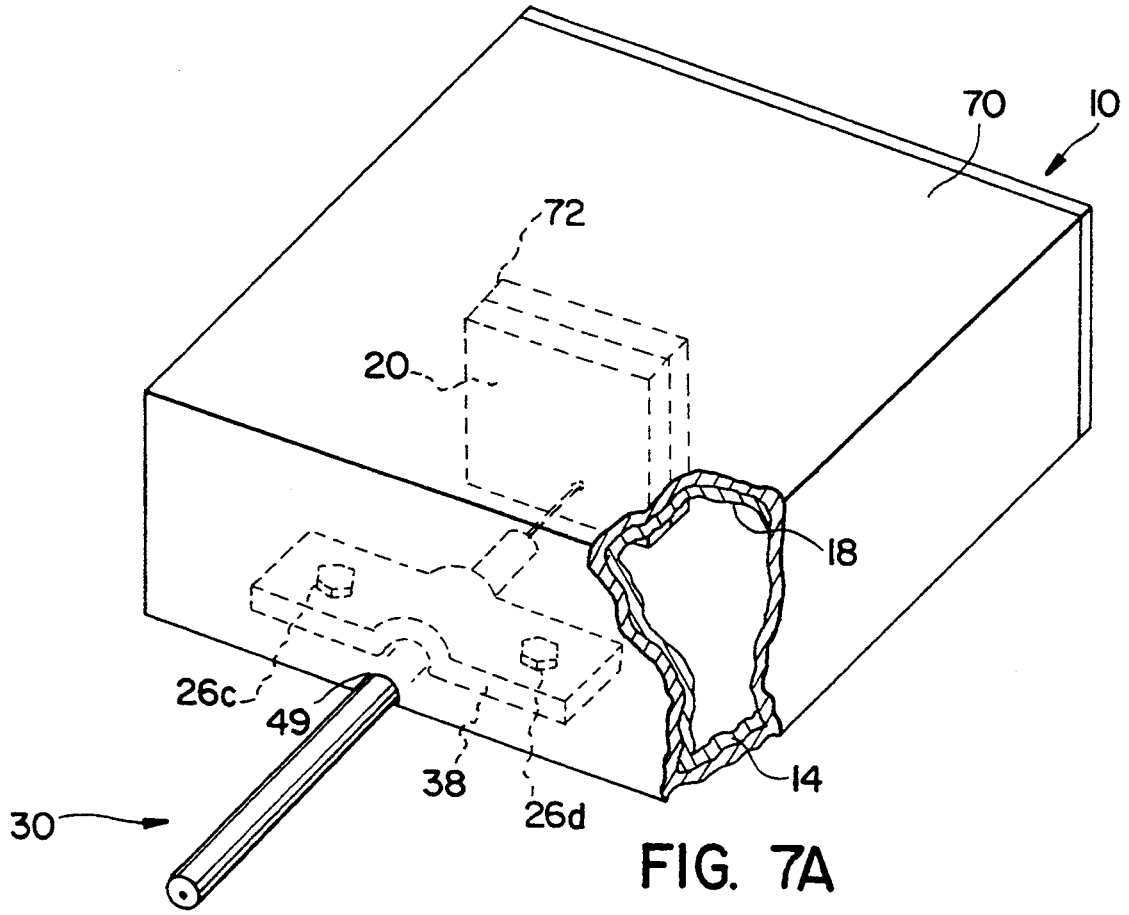
FIGS. 7A and 7B illustrate an embodiment of the microstrip antenna where the microstrip element is realized by coating or depositing an electrically conductive material on a substantially non-electrically conductive material, such as plastic.
Figure 7B:
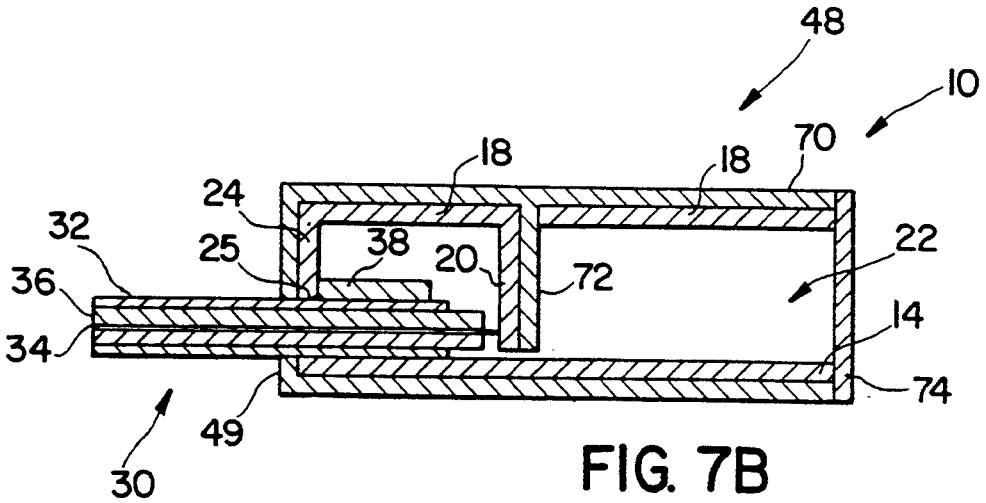

FIGS. 7A–7B illustrate another embodiment of the antenna 10 in which the feed member 20 is integral or continuous with the planar member 18 of the microstrip element 16. Elements of the embodiment of the antenna 10 illustrated in FIGS. 7A and 7B that are substantially equivalent to the elements to the embodiment of the antenna 10 illustrated in FIGS. 1 and 2A–2C in a functional sense are given the same reference numbers. The antenna 10 illustrated in FIGS. 7A–7B integrates the ground plane 14, the microstrip element 16, the shorting section 24, and the radome 48 into a single molded unit by depositing electrically conductive material for the ground plane 14, the microstrip element 16, and the shorting section 24 on a substantially non-electrically conductive material, such as plastic, that functions as the radome 48. Specifically, the radome 48 includes a shell 70 upon which an electrically conductive material is deposited to realize the ground plane 14, the planar member 18 of the microstrip element 16, and the shorting section 24. The radome 48 also includes a rib 72 upon which electrically conductive material is deposited that is continuous with the electrically conductive material that forms the planar member 18 and the shorting section 24 to realize the feed member 20. A cap 74 that is bonded to the shell 70 completes the radome 48. Due to this integration of elements of the antenna 10, assembly of the antenna 10 is accomplished in a relatively short period of time, and as a consequence, with little expense. Specifically, the required physical connection between the transmission line 30 and the ground 14 is established using the cable clamp 38 and the sheet metal screws 26C and 26D before the cap 74 is attached to the shell 70. The cable clamp 38 and the sheet metal screws 26C and 26D also establish the electrical connection between the first electrical conductor 32 of the transmission line 30 and the ground plane 14. Soldering or some other manner of establishing an electrical connection is used to create the electrical connection between the second electrical conductor 34 and the feed member 20 of the microstrip element 16. Once the foregoing connections have been completed, the cap 74 is attached to the shell 70 by any of the known devices or methods employed in the art. For example, an adhesive or ultrasonic bonding can be employed.

The foregoing description of the invention has been presented for purposes of illustration and description. Further, the description is not intended to limit the invention to the form disclosed herein. Consequently, variations and modifications commensurate with the above teachings, and the skill or knowledge in the relevant art are within the scope of the present invention. The preferred embodiment described hereinabove is further intended to explain the best mode known of practicing the invention and to enable others skilled in the art to utilize the invention in various embodiments and with various modifications required by their particular applications or uses of the invention. It is intended that the appended claims be construed to include alternate embodiments to the extent permitted by the prior art.

What is claimed is:

1. A microstrip antenna suitable for use in mobile radio communication applications, comprising:

a first element that has a first substantially planar surface that is electrically conductive and extends from a first right terminal end to a first left terminal end;

a second element that includes a second substantially planar surface that extends from a second right terminal end to a second left terminal end and is electrically conductive and further includes a member that is made from the same piece of material as said second substantially planar surface, is located between said second right terminal end and said second left terminal end, has a free end, and is also electrically conductive, said second substantially planar surface being located substantially parallel to said first substantially planar surface wherein a space is defined intermediate to said first substantially planar surface and said second substantially planar surface, said free end of said member being located within said space and at an angle that is other than parallel to said second substantially planar surface;

a third element that is electrically conductive and extends between said second left terminal end of said second substantially planar surface and said first substantially planar surface;

wherein one of said first substantially planar surface and said second substantially planar surface has a length that is substantially equal to one-quarter of the wavelength (λ) of the center frequency to which the microstrip antenna is tuned; and transmission line means for coupling radio frequency signals to said first substantially planar surface and said member, said transmission line means includes a first conductor that is electrically connected to said first substantially planar surface and a second conductor that is electrically connected to said free end of said member at a point within said space.

2. A microstrip antenna, as claimed in claim 1, wherein:

said first element includes means for use in magnetically attaching said first substantially planar surface to a ferrous object.

3. A microstrip antenna, as claimed in claim 1, wherein:

said second element includes a substantially non-electrically conductive material, wherein at least one of said second substantially planar surface and said member is coated on said substantially non-electrically conductive material.

4. A microstrip antenna, as claimed in claim 1, wherein:

said second element includes a low-adhesion material located on at least one of the following: said second substantially planar surface and said member.

5. A microstrip antenna, as claimed in claim 1, wherein:

said member is substantially non-inductive.

6. A microstrip antenna, as claimed in claim 1, wherein:

said transmission line means has a characteristic impedance;

said member is integrally connected to said second substantially planar surface at a location that has substantially said characteristic impedance of said transmission line means.

7. A microstrip antenna, as claimed in claim 1, wherein:

said space contains a dielectric.

8. A microstrip antenna, as claimed in claim 1, wherein:

said space includes air.

9. A microstrip antenna, as claimed in claim 1, wherein:

a portion of said transmission line means is located in said space, said portion extending from said member to an edge of said space, wherein said portion is located in one of the following orientations: substantially parallel to said first substantially planar surface and substantially perpendicular to said first substantially planar surface.

10. A microstrip antenna, as claimed in claim 1, wherein:

a portion of said transmission line means is located in said space, said portion extending from said member to an edge of said space, wherein said portion lies in a single plane that is substantially parallel to said first substantially planar surface throughout said space.

11. A microstrip antenna, as claimed in claim 1, wherein:

a portion of said second conductor of said transmission line means is located in said space, said portion extending from said member to an edge of said space wherein said portion of said second conductor extends in substantially a straight line within said space.

12. A microstrip antenna, as claimed in claim 1, wherein:

said third element is integral with one of said first substantially planar surface and second substantially planar surface.

13. A microstrip antenna, as claimed in claim 1, wherein:

said third element is integral with said first substantially planar surface and said second substantially planar surface.

14. A microstrip antenna, as claimed in claim 1, wherein:

said first element has a side surface; and further including;

a radome for covering at least said second element and having an interior surface;

wherein at least a portion of interior surface of said radome covers at least a portion of said side surface of said first element.

15. A microstrip antenna, as claimed in claim 1, wherein:

said second substantially planar surface includes a hole that is defined by an edge, wherein said member defines at least a portion of said edge.

16. A microstrip antenna, as claimed in claim 1 wherein:

said member includes a plate.

17. A microstrip antenna, as claimed in claim 1, wherein:

at least one of said first element and said second element is substantially rectangular.

18. A method for manufacturing a microstrip antenna, comprising:

providing a first electrically conductive structure having a first substantially planar surface that extends from a first right terminal end to a first left terminal end;

forming a second electrically conductive structure having a second substantially planar surface that extends from a second right terminal end to a second left terminal end, and further includes a member that is made from the same piece of material as said second substantially planar surface, is located between said second right terminal end and said second left terminal end, and has a free end that is at an angle other than parallel to said second substantially planar surface;

providing a third electrically conductive structure;

wherein one of said first substantially planar surface and said second substantially planar surface has a length that is substantially equal to one-quarter of the wavelength (λ) of the center frequency to which the microstrip antenna is tuned;

positioning said first electrically conductive structure, said second electrically conductive structure and said third electrically conductive structure so that said first substantially planar surface is substantially parallel to said second substantially planar surface and said free end of said member is positioned in a space located intermediate to said first substantially planar surface and said second substantially planar surface and so that said third element extends between said second left terminal end and said first element;

providing a transmission line means for coupling a radio frequency signal to said first electrically conductive structure and said second electrically conductive structure, said transmission line means including a first conductor and a second conductor;

first electrically connecting said first conductor of said transmission line means to said first substantially planar surface; and second electrically connecting said second conductor of said transmission line means to said free end of said member.

19. A method, as claimed in claim 18, wherein:

said step of forming includes bending a piece of electrically conductive material to form said member of said second electrically conductive structure.

20. A method, as claimed in claim 18, wherein:

said step of forming includes depositing electrically conductive material on a substantially non-electrically conductive material having surfaces appropriate for said second substantially planar surface and said member.

21. A method, as claimed in claim 18, wherein:

said step of second electrically connecting includes establishing said second conductor in a plane that is substantially parallel to said second substantially planar surface.

22. A method, as claimed in claim 18, wherein:

said step of second electrically connecting includes establishing said second conductor in a substantially straight line throughout said space.

* * * * *